United States Patent [19]

Huebner et al.

[11] 3,980,003

[45] Sept. 14, 1976

[54] VARIABLE HYDROSTATIC BEARING BETWEEN BARREL AND HEAD OF AXIAL PISTON UNITS

[75] Inventors: Robert J. Huebner, Peoria, Ill.; Carman P. Lynnes, Leonard, N. Dak.; Ralph A. Matzelle, Brimfield; Richard L. M. Sears, Washington, both of Ill.

[73] Assignee: Caterpillar Tractor Co., Peoria, Ill.

[22] Filed: Feb. 7, 1975

[21] Appl. No.: 547,907

[52] U.S. Cl. ..... 91/487; 308/9; 308/78

[51] Int. Cl.[2] ..... F01B 13/04

[58] Field of Search ..... 91/487, 489, 486; 308/9, 78

[56] References Cited

UNITED STATES PATENTS

| | | | |
|---|---|---|---|
| 2,298,850 | 10/1942 | Vickers | 91/487 |
| 3,040,672 | 6/1962 | Foerster et al. | 91/487 |
| 3,183,846 | 5/1965 | Skinner | 91/499 |
| 3,292,553 | 12/1966 | Hann | 91/486 |
| 3,702,576 | 1/1972 | Pruvot | 91/487 |
| 3,800,673 | 4/1974 | Lutz et al. | 91/487 |
| 3,803,984 | 4/1974 | Lachner | 91/487 |
| 3,808,950 | 5/1974 | Davies | 91/487 |
| 3,841,720 | 10/1974 | Kouach et al. | 308/9 |
| 3,851,669 | 12/1974 | Zellbeck et al. | 91/487 |

*Primary Examiner*—M. H. Wood, Jr.
*Assistant Examiner*—Richard A. Bertsch
*Attorney, Agent, or Firm*—Phillips, Moore, Weissenberger, Lempio & Strabala

[57] ABSTRACT

A hydraulic fluid pressure energy translating machine is provided with hydrostatic pressure-balancing means which communicate with the primary port to balance hydrostatic forces acting on the barrel during operation of the machine to maintain an optimum bearing clearance between the head and barrel, thereby controlling fluid leakage and maintaining adequate lubrication and support at this interface.

7 Claims, 3 Drawing Figures

VARIABLE HYDROSTATIC BEARING BETWEEN BARREL AND HEAD OF AXIAL PISTON UNITS

BACKGROUND OF THE INVENTION

This invention relates to hydraulic fluid pressure energy translating machines or devices. In particular, this invention relates to hydrostatic barrel support bearings for parallel disposed multi-piston machines of the type used to convey or respond to hydraulic fluids, or the like.

Conventionally, such machines comprise a rotatable cylinder block or barrel containing a plurality of parallel axially-extending pistons disposed equi-angularly about the central axis of the block. A cam plate is provided at one end of the barrel for engaging bearing shoes provided on each of the pistons and for respectively reciprocating each piston or rotating in response to the pistons as fluid moves into and out of each piston-containing cylinder. Such machines are generally equipped with ported head means for providing a valving action for ingress and egress of fluid into and out of the cylinders of the machine. The port means further typically is formed in means such as a cap at the head end of the housing that also has means that provides a hydrostatic bearing area against which the axial thrust of the barrel may be balanced. This bearing is generally provided by flowing oil across sills at the interface of the head and barrel surrounding the ports which minimizes contact of these elements and prevents seizure.

Although it is highly desirable from the standpoint of control of fluid leakage and the maintenance of adequate lubrication to have the head and barrel mating surface properly spaced and aligned, this alignment is usually difficult to maintain during operation of the machine due to the well-known propensity of the barrel to tilt in a radial direction. This effect is primarily caused by radial components of force acting on the barrel through the pistons being in different planes. When the barrel tilts as a result of these forces, the mating surface of the barrel and bearing surface of the head are urged out of alignment into an inclined position, resulting in undesirable fluid leakage, and disruption of the lubricating oil film.

The problem of barrel tilt is especially severe with inset porting, i.e., where the cylinder ports are inset toward the barrel axis side of the cylinders. This inset of the ports is found to improve cylinder filling and is especially desirable for high-speed pumps and motors.

Additionally, in conventional axial piston-type fluid machines, the barrel has a tendency to move axially against the bearing surface of the head during operation of the machine in response to axial components of force generated by the pressurized fluid in the cylinders. This net force urging the barrel against the head, generally termed the hydraulic clamp force, tends to reduce clearance between the bearing surface of the head and the barrel mating surface, and acts in opposition to the hydrostatic bearing provided at this interface thereby decreasing the clearance between the barrel and head. In the event, for example, of transient over pressure in the cylinders, the hydraulic clamp force may significantly increase, and the concomitant decrease in bearing clearance at this interface results in wear and galling on these elements, and occasional seizure. As the rotational speeds increase, the forces tending to cause axial and radial displacement of the barrel also increase, disrupting the alignment and the clearance between the bearing surface of the head and the mating surface of the barrel, or "bearing clearance," thereby resulting in fluid leakage and/or insufficient lubrication of the head/barrel interface.

Inset porting also tends to cause an imbalance of moments on the barrel further aggravating these problems. This is caused by the centroid of the clamping forces not being colinear with the centroid of the separating forces. This results in higher tipping moments due to non-colinearity of clamping and separating forces.

These problems have been recognized in the prior art, and numerous solutions proposed therefor, such as those described in U.S. Pat. Nos. 3,183,846; 2,735,407; 3,267,871 and 3,292,553, including means for laterally stabilizing the cylinder barrel such as described in U.S. Pat. No. 3,267,871 and floating valve means such as described in U.S. Pat. No. 2,649,741. Other approaches are shown in 2,298,850; 3,267,871; 3,702,576, and 3,747,476. However, none of these known prior art solutions have proved entirely satisfactory. For example, difficulties have been encountered in resolving the attendant problems of maintaining satisfactory head/barrel clearance under variable operating conditions in pumps having axially floating barrels, wherein substantial variations in temperature, pressure, rotational speed, vibrations and other factors occur. It is highly desirable that means be provided for simply and effectively compensating for the variable forces developed within the pump to maintain adequate head clearance during pump operation, for controlling fluid leakage which impairs the efficiency of the pump, and for accommodating an adequate lubricating oil film between the head/barrel interface which prevents excessive wear, or in extreme cases, seizure of these elements.

SUMMARY AND OBJECTIVES OF THE INVENTION

Accordingly, the invention comprises an axial multi-piston type hydraulic machine such as a pump or motor including a laterally constrained barrel, floatingly disposed axially against a ported head and responsive to hydrostatic forces between the head and barrel to support the barrel. Optimum bearing clearance is maintained between the bearing surface of the head and the mating surface of the barrel during operation of the pump by an appropriate balance of the hydrostatic forces provided by both sills and hydrostatic pads, thereby controlling fluid leakage and maintaining satisfactory lubricant levels at the head/barrel interface.

Balancing means for obtaining an appropriate balance of hydrostatic forces acting against the head to maintain optimum bearing clearance include a plurality of hydrostatic pads comprising fluid-containing recess means within the port plate at the head/barrel interface, and flow control means including an orifice for regulating fluid flow to these recess means. The resulting hydrostatic forces exerted on the barrel balance other hydrostatic forces present also acting on the barrel and provide an optimum bearing clearance for satisfactory lubrication and leakage control between the barrel and head.

It is therefore an object of this invention to provide an axial multi-piston type pump having means for maintaining an optimum bearing clearance during pump operation.

It is yet another object of this invention to provide an axial multi-piston type pump having an axially floating barrel and means for maintaining an optimum bearing clearance during pump operation.

DETAILED DESCRIPTION OF A PREFERRED EMBODIMENT

Figure 1:
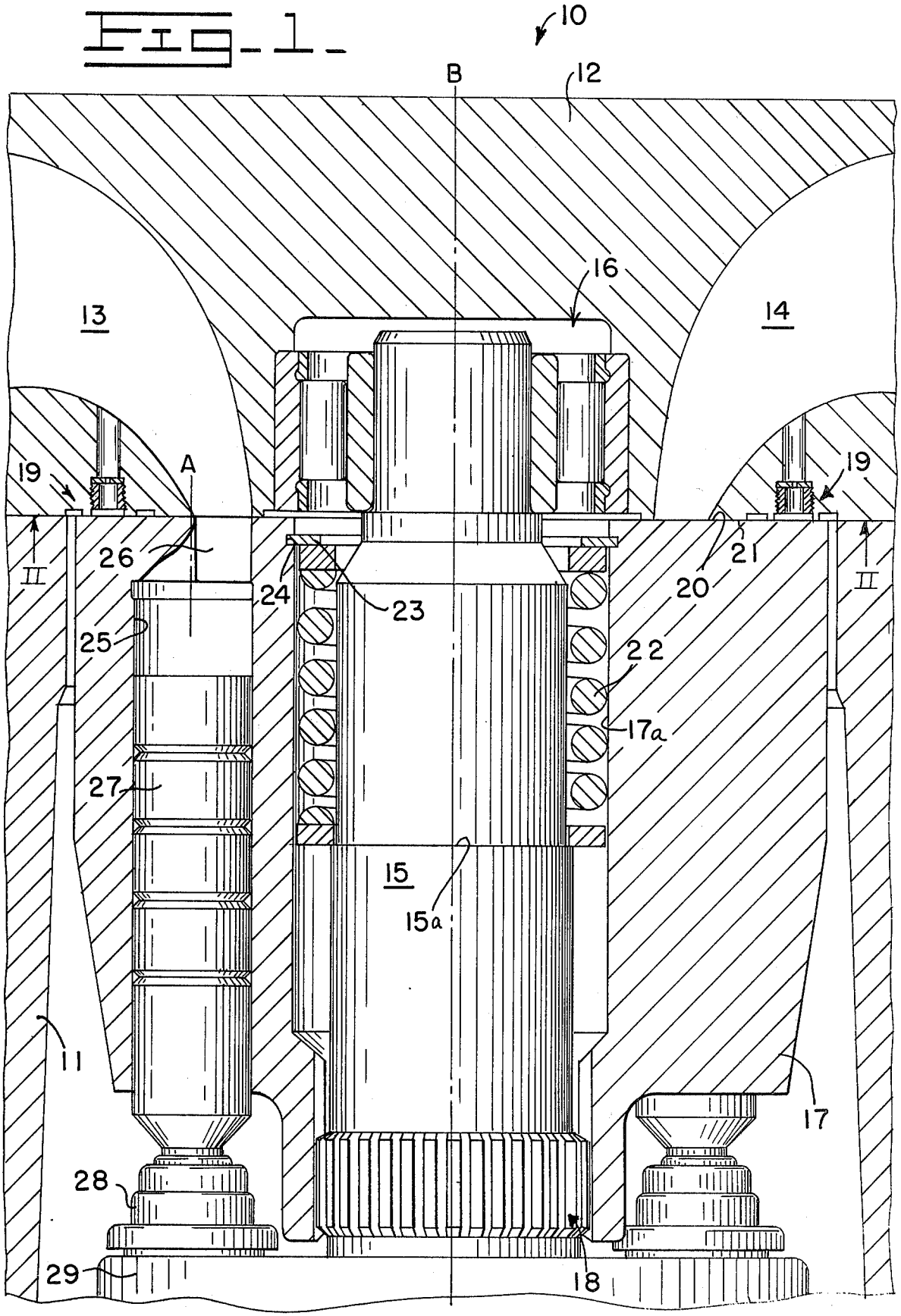
FIG. 1 is a cross-sectional view of an axial multi-piston type machine, having hydrostatic pressure balancing means in accordance with this invention.

With particular reference to FIG. 1, a hydraulic fluid pressure energy translating machine which will be described as an axial multi-piston pump is illustrated generally at 10.

It is to be understood that the principles of this invention will also apply to a motor. The pump 10 includes a housing 11 provided with a ported head or cap 12 mounted on one end thereof and a base not shown at the other end thereof. The head 12 has formed therein a fluid discharge port 13 and a fluid supply port 14 leading into the pump for discharge and introduction of fluid respectively. A drive shaft 15 is rotatably mounted coaxially within the housing 11 by suitable bearing means 16 and is drivingly connected to suitable motor means, not shown, for rotation within the housing. A generally cylindrical barrel or cylinder block 17 is coaxially mounted about the shaft 15 and is operably connected thereto by suitable means such as splines 18 so that rotation of the shaft 15 is accompanied by rotation of the barrel 17. Barrel 17 is also suitably mounted for axial displacement toward head 12 and is supported in spaced relationship therefrom by a suitable hydrostatic bearing assembly generally designated by the numeral 19 disposed between the upper annular surface 20 of the barrel 17 and annular surface 21 of the head 12. This hydrostatic bearing assembly means will be described in detail below. The barrel 17 is biased by means of a compression spring 22 which is disposed between barrel 17 and the shaft 15 within a central bore 17*a* of the barrel. The spring is compressed between shoulder 15*a* formed on shaft 15 and a retainer ring 23 retained in a suitable annular groove 24 formed in bore 17*a* of barrel 17. The spring 22 biases the barrel 17 upward toward bearing means 19.

The barrel 17 is provided with the usual plurality of annularly disposed cylindrical bores 25 each having a port 26 at the upper end thereof for communicating with primary inlet and outlet ports 13 and 14. A piston 27 is disposed in each of the cylindrical bores 25 for reciprocation therein to pressurize fluid within the cylinder. Each of the pistons 27 is provided with a slipper or shoe 28 which is suitably secured to lower end thereof and slidably engages a suitable cam or swash plate 29 which cams the pistons 27 for reciprocation in the bores 25 upon rotation of the barrel 17.

It should be noted that the ports 26 are inset to one side of the axis A of the bores 25 toward the axis B of barrel 17. Positioning the ports inward in this manner improves the filling of the cylinders during operation. It can be seen that centrifugal force will work toward filling the cylinders rather than against it as with ports that are displaced outward.

This movement of the ports inward, however, has the disadvantage of inducing a moment imbalance on the cylinder barrel. Thus some means must be provided to compensate for this imbalance.

Figure 2:
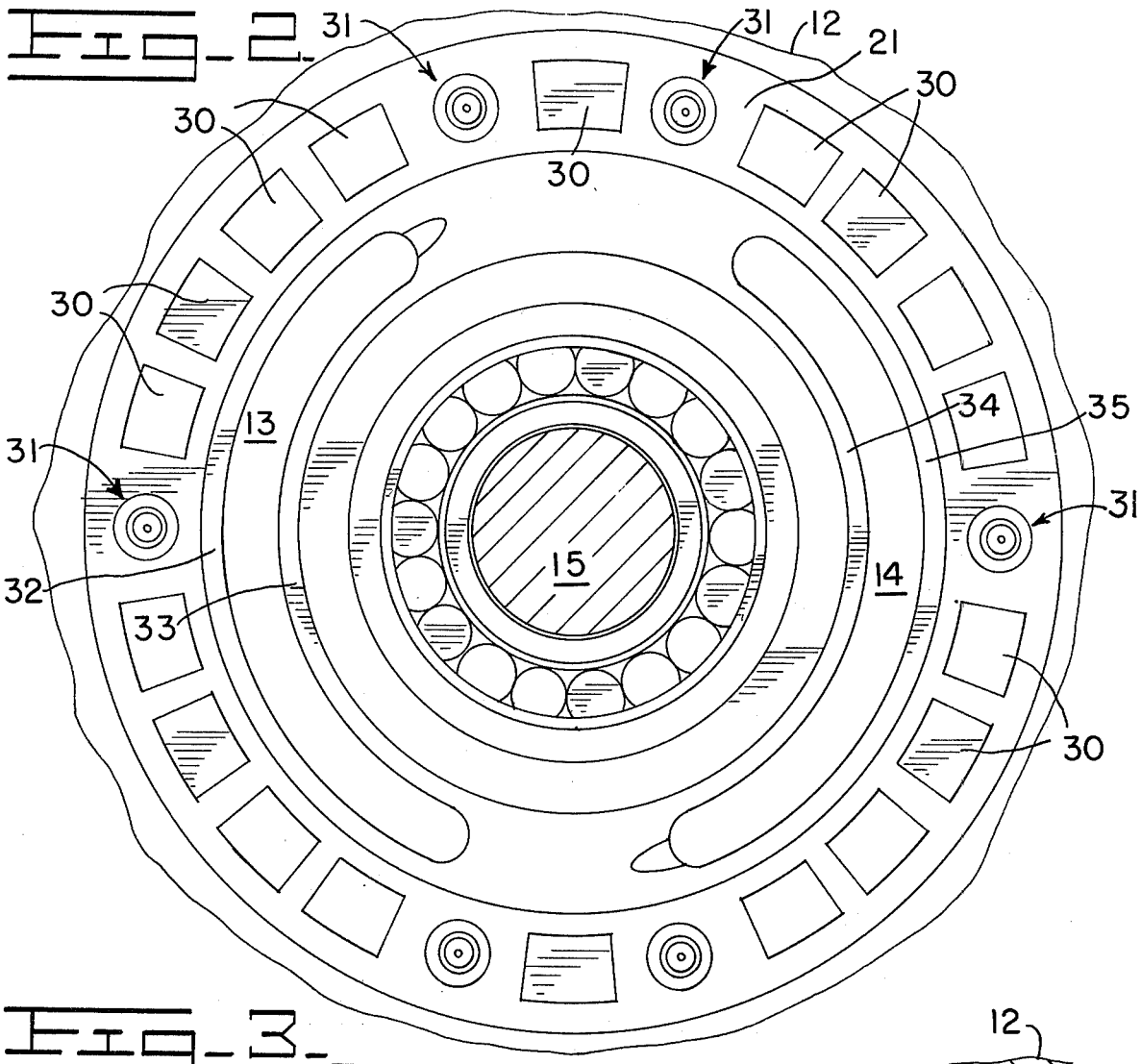
FIG. 2 is a view of the bearing surface taken generally along lines II—II of FIG. 1.

With reference now to FIG. 2 there is illustrated the annular suface 21 of head 12 which also contains the port means and also suitably illustrates the hydrostatic bearing means. As seen in FIG. 2 the ports 13 and 14 comprise arcuate openings extending approximately a third of the way around the face 21 of head 12 and are each disposed on opposite sides of the drive shaft 15. These primary ports provide continuous communication with a given cylinder over the specified angle as a piston moves through its stroke. An alternate method, not shown, would be a port plate insert including the hydrostatic bearing means and the arcuate openings of ports 13 and 14. This port plate insert would be firmly affixed to the head in the usual manner.

Figure 3:
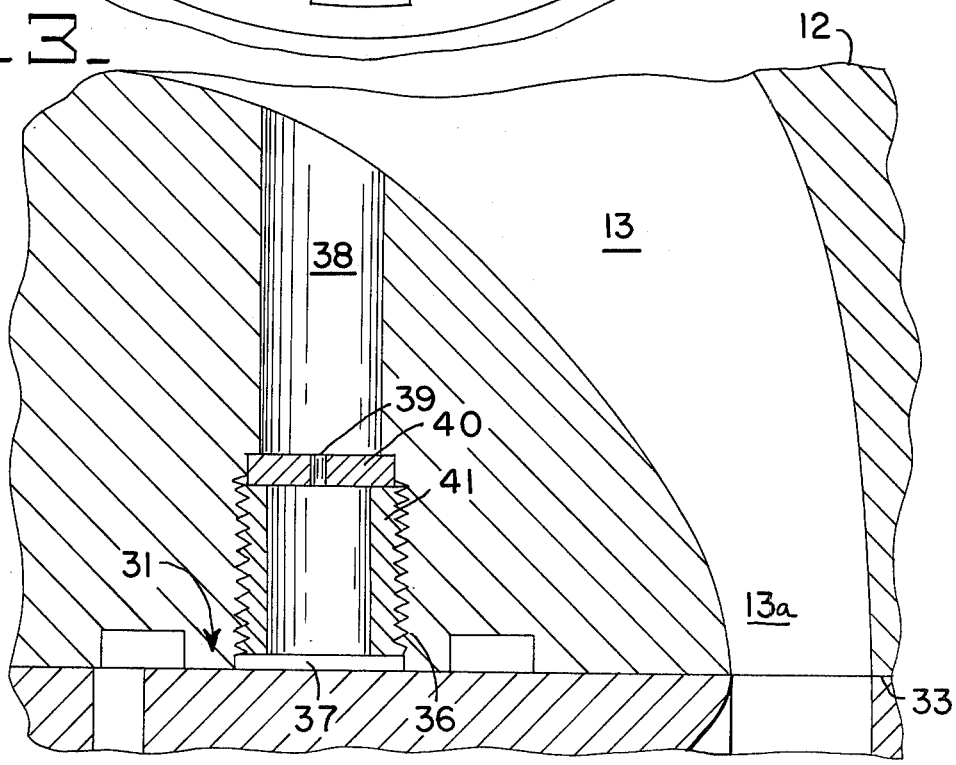
FIG. 3 is an enlarged cross-sectional view showing in detail the primary port and hydrostatic pad arrangement in accordance with the invention.

As also best seen in FIG. 2 the face 21 of head 12 is formed with a plurality of support blocks 30 extending along in an arcuate path adjacent each of the ports 13, 14. Disposed among the blocks adjacent each of the ports are pads 31 which are supplied with hydrostatic fluid from a primary port as shown in FIG. 3. FIG. 3 illustrates one arrangement of pads and blocks. The arrangement is changed as necessary to provide optimum balance for the specific cylinder barrel and head design.

Port 13 is provided with sills 32 and 33 extending around a periphery thereof. Similar sills 34 and 35 extend along and around the port 14.

The details of the hydrostatic pad of the present invention are best seen in FIG. 3. The hydrostatic pad 31 as best seen in FIG. 3 comprises an annular sill 36 surrounding and forming a recess 37 to which is communicated pressurized fluid from the primary port 13 by way of a passage 38. Disposed within the passageway 38 is an orifice 39 for controlling the pressurized fluid supplied to the recess 37. The orifice 39 is formed in a suitable orifice plate 40 which is removably secured in place within passage 38 by suitable means such as a sleeve 41 threadably inserted into passageway 38. As will also be noted in FIG. 3, the communication of passage 38 with primary port 13 is spaced from the mouth 13A or point of direct communication thereof with the cylinder port. This results in communication of a more even pressure from port 13 to the pad 31 than would occur if the communication were direct from the cylinder itself.

This arrangement of hydrostatic bearings still makes use of sills 32–33 to provide separating forces between the head and barrel. However, this force developed by sills 32–33 provides only a portion of the total force required. Additional forces come from the hydrostatic pads 31, located in the vicinity of and communicating directly with the primary ports. These pads 31 are fed with pressurized oil through passage 38 connected to the primary port. In each of the ports an orifice 39 is operative to provide control of the flow of fluid and the pressure in the pad recess area 37. The orifice 39 is formed in a removable orifice plate 40 held in place by a removable sleeve or fitting 41 secured such as by threads in passage 38.

The invention works in the following manner. The maximum potential separating force acting between the head and barrel is a combination of the effect of the primary sills and pads and is larger than the maximum clamping force available. However, under normal operating conditions oil flowing through the orifice to the pads is reduced in pressure so that this portion of the separating force is decreased so that overall separating and the clamping forces are in balance. When the barrel moves further from the head, flow through the orifices increases, further dropping the pad pressure, thereby permitting the clamping forces to move the barrel back toward the head until a balance of forces is again achieved. When the barrel moves too close to the head, orifice flow drops, resulting in an increase of pressure in the pad and increasing the separating force to push the barrel away until balance is again achieved.

Thus, from the above description it can be seen that there is provided a hydraulic pump having a hydraulic bearing system comprising the sills of the pump head and hydrostatic pads to balance clamping forces and tilting moments on the barrel of the pump. The hydrostatic pads are provided with pressure fluid from the primary port with the pressure of the fluid being controlled by means of orifices disposed in the passages to the pad areas. Thus, a combination of forces are used to balance the clamping force and maintain proper spacing of the pump barrel from the head of the machine as well as prevent tilting of the barrel.

While this invention has been described with respect to a single embodiment, it is to be understood that numerous modifications and changes may be made in the disclosed embodiment without departing from the spirit and scope of this invention as defined in the appended claims.

What is claimed is:

1. A port cap for a hydraulic fluid pressure energy translating device having a rotatable barrel axially floatingly disposed adjacent said port cap of said device, said port cap having inlet and outlet ports inset to the barrel axis side of the axis of the cylinders of said device and having hydrostatic pressure balancing means for balancing forces and moments within the device acting on said barrel to obtain an optimum bearing clearance between said port cap and said barrel;

said balancing means further including a plurality of fluid-containing recess means within a bearing surface of said port cap and flow control means for regulating flow from a port of said device into said recess means; and, wherein said flow control means includes a fluid-flow passageway communicating between a port of said port cap and said recess means, said flow control means further including fluid-restricting means between said passageway and said recess means for regulating pressure within said recess means.

2. The port cap of claim 1 wherein said fluid restricting means comprises an orifice formed in an orifice plate, and said orifice plate is removably mounted in said fluid-flow passageway adjacent said recess means.

3. In a hydraulic fluid pressure energy translating device of the type having a housing provided with a port cap at one end thereof having inlet and outlet ports formed therein and a base at the other end thereof; a rotatable barrel connected to a shaft for rotation therewith, said barrel containing a plurality of cylindrical bores annularly disposed within said barrel for orbiting about the longitudinal axis thereof; a plurality of pistons mounted for reciprocation in said bores as said barrel is rotated; the improvement comprising:

barrel-constraining means for constraining the barrel against axial displacement during operation, said constraining means comprising hydrostatic pads disposed between said barrel and said port cap; and passage means communicating pressurized fluid from at least one of said ports to said hydrostatic pads, said constraining means further includes a plurality of fluid-containing recess means for defining said hydrostatic pads between said port cap and said barrel, and flow control means for regulating fluid flow into said recess means, said flow control means including a fluid-flow passageway communicating between a port of said port cap at a point spaced from said barrel and said recess means for fluid flow to said recess, said flow control means further including orifice means between said passageway and said recess means for regulating pressure within said recess means.

4. The invention of claim 3, wherein said inlet and outlet ports are inset toward the axis of said barrel from the axis of said cylindrical bores so that communication of fluid thereto is to the inner side of said cylindrical bores;

said barrel-constraining means includes a first pair of hydrostatic bearing pad means radially disposed on opposite side of said shaft and outward of said ports, and a second pair of hydrostatic bearing pad means radially disposed between said inlet and outlet ports.

5. The invention of claim 3, wherein said inlet and outlet ports are inset toward the axis of said barrel from the axis of said cylindrical bores so that communication of fluid thereto is to the inner side of said cylindrical bores;

said barrel-constraining means includes a first pair of hydrostatic bearing pad means radially disposed on opposite sides of said shaft and outward of said ports, a second pair of hydrostatic bearing pad means disposed radially outward from a position between said inlet and outlet ports, and a third pair of hydrostatic bearing pad means disposed radially outward from a position between said inlet and outlet ports on the opposite side of the axis of said barrel from said second pair of pads.

6. The invention of claim 5 comprising a pair of mechanical blocks disposed between the pads of each of said second and third pair of pads.

7. The hydraulic fluid pressure device of claim 3 wherein said orifice means is defined by an aperture formed in an orifice plate, and said orifice plate is removably mounted within said fluid-flow passageway adjacent said recess means.

* * * * *